United States Patent [19]

Gross

[11] 4,215,616

[45] Aug. 5, 1980

[54] ASYNCHRONOUS TONE GENERATOR

[75] Inventor: Glenn M. Gross, Chicago, Ill.

[73] Assignee: Norlin Industries, Inc., Lincolnwood, Ill.

[21] Appl. No.: 42,021

[22] Filed: May 24, 1979

[51] Int. Cl.[3] ..... G10H 1/02; G10H 5/06

[52] U.S. Cl. ..... 84/1.01; 84/1.24; 84/DIG. 4; 84/DIG. 11

[58] Field of Search ..... 84/1.01, 1.24, DIG. 4, 84/DIG. 11

[56] References Cited

U.S. PATENT DOCUMENTS 3,828,109 8/1974 Morez ..... 84/1.01

*Primary Examiner*—S. J. Witkowski

*Attorney, Agent, or Firm*—Ronald J. Kransdorf; Jack Kail

[57] ABSTRACT

In an electronic organ of the time-sharing type, a single clock source drives a number of variable divisor frequency dividers which are assigned different divisor values to produce different musical tones at different times. In order to prevent phase synchronism between two simultaneously operating dividers, and thus achieve a rolling phase relationship which is perceived as a chorus effect, divisor values are employed for the two frequency dividers which are not in a whole number relationship. If the two dividers are generating octavely related notes, the divisors used have a ratio not quite equal to the nominal 2:1 value which musical theory requires. Moreover, the exact value of the ratio varies from note to note within each octave so that the rate of phase roll is not monotonously the same for all notes. Alternatively, if the two dividers are both generating the same note, then the divisors used have a ratio which is not quite equal to the 1:1 value which musical theory requires.

23 Claims, 7 Drawing Figures

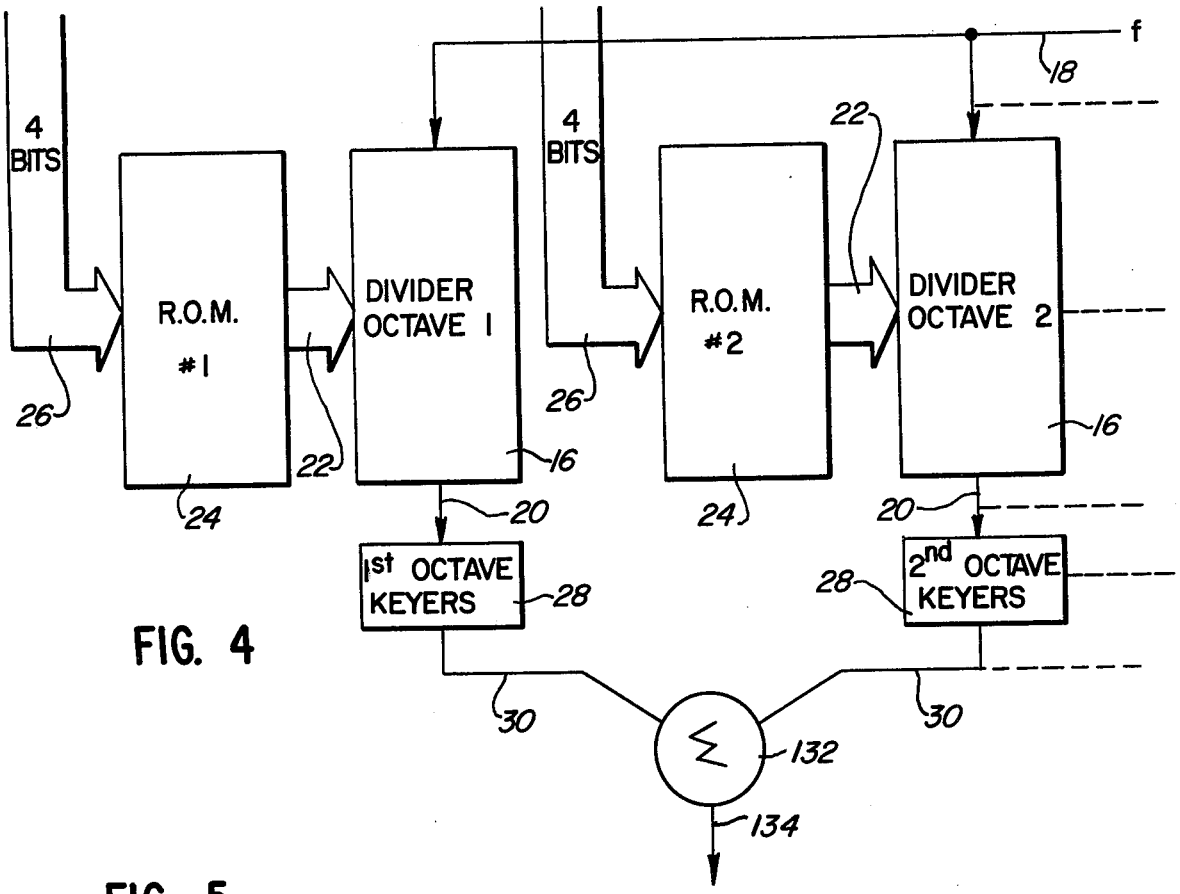
FIG. 4
FIG. 5
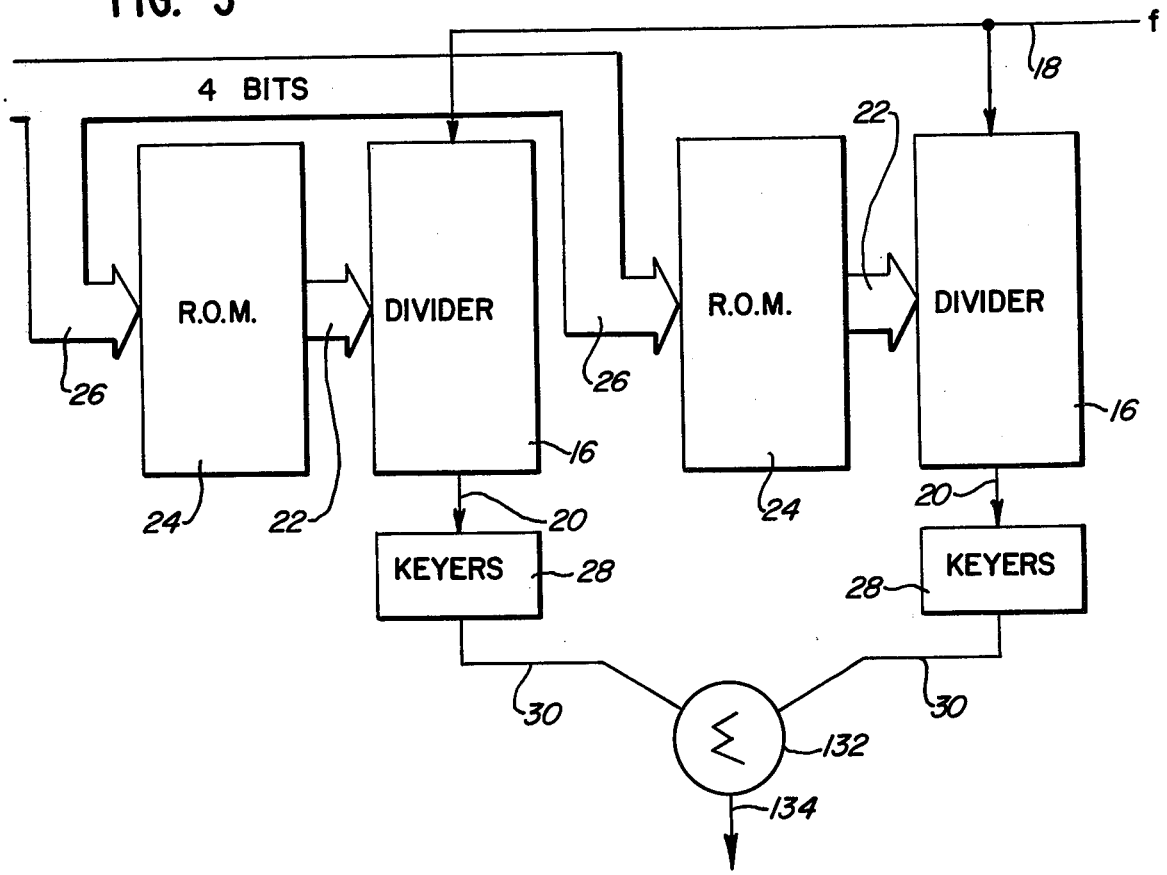

ASYNCHRONOUS TONE GENERATOR

This invention relates generally to electronic musical instruments such as organs, especially those which do not employ a separate tone generator for each note.

BACKGROUND OF THE INVENTION AND PRIOR ART

Electronic instruments which employ a separate tone generator for each note within the range of the instrument tend to be expensive because a large number of tone generators are required; for example, there are sixty-one notes within the musical range of a typical electronic organ. Accordingly, in recent years other tone generation techniques have been adopted which produce the same number of notes but require a much smaller number of tone generators. All of these techniques involve the generation of a limited number (one or more) of high frequencies from which all the necessary lower frequencies are obtained by dividing down. Because of this derivative relationship between the low frequencies and the higher ones, they are necessarily synchronous in phase. This phase synchronism causes a problem whenever octavely related notes are played simultaneously: the resulting chord has a thin, dry sound, unlike the full chorus effect which is characteristic of an acoustic instrument and also of an expensive electronic instrument having an individual tone generator for each note.

There are a number of different versions of the frequency division technique for lower tone generation, and they all suffer from this problem. One variation is to employ twelve chromatic notes of the highest octave. Then the corresponding notes of all the lower octaves are obtained by twelve respective frequency division flip-flop chains proceeding in octave steps (i.e. each step involves division by two). Now that digital techniques and integrated circuit chips are widely used in electronic musical instruments, an even more economical variation of this technique employs a top-octave synthesizer chip driven by a single high frequency clock source to generate the twelve highest notes.

There is another variation of the frequency division approach which, like the top-octave synthesizer approach, also requires only one high frequency clock source. In this method, a limited number of variable divisor frequency dividers are used on a time-sharing basis. Only as many frequency dividers are used as are necessary to cover the maximum number of notes which a player will ask the instrument to play simultaneously, e.g. ten to twelve. Each frequency divider can be made to generate any one of the sixty-one notes in the musical range of the instrument, by specifying the proper divisor.

Each of these approaches tends to produce dry-sounding octave chords, because of the phase synchronization between any two octavely related notes. In the time-sharing system, for example, regardless of which divisors are employed at any moment, each frequency divider derives its high frequency signal from the same source as every other frequency divider does. If any two of these dividers are playing octavely related notes simultaneously, the ratio between their output tone frequencies will be exactly 2:1. Whenever two signals are sub-multiples of the same source, and their frequencies are in any integral ratio (such as 2:1), their waveform will be synchronized in phase, producing an undesirable thin, dry sound. The top-octave design approach also suffers from this tendency, because every pair of octavely related notes is derived by dividing the same signal source, and they also are related in frequency by a 2:1 ratio exactly.

In contrast, acoustical instruments and electrinic instruments of the independent generator type produce a pleasing full chorus audio effect, even when octavely related notes are sounded simultaneously. This is because there is unlikely to be phase synchronism between the waveforms produced by any two randomly related acoustical or electronic sources. An additional reason is the probability that their frequency ratio will differ slightly from the 2:1 mathematically ideal value, even though they are nominally in an octave relationship.

In order to make an electronic instrument of the single clock source type sound more natural, U.S. Pat. No. 3,828,109 of Morez, in FIGS. 1 and 4, has suggested the following approach. The clock frequency is divided down in successive steps of two by a chain of flip-flops, and these 2:1 related outputs are applied to the respective inputs of individual octave synthesizer circuits, which then create the full chromatic scale (twelve notes) for respective individual octaves. But special means are provided for adding or subtracting small numbers of pulses at the inputs of all but one of the synthesizer circuits, so that their effective source frequency ratios are slightly detuned, i.e. they differ slightly from the nominal 2:1 value. One disadvantage of this approach is that it requires a multiplicity of octave synthesizers, one for each octave in the musical range of the instrument. In addition, this approach is not applicable to the time-shared frequency divider type of instrument.

Furthermore, in this arrangement the altered source frequency differs only from one octave to another octave, but not from one note to another note within an octave. Consequently, while each pair of octavely related notes has a frequency ratio slightly detuned from the ideal 2:1 value, the degree of detuning is exactly the same for each note within an octave; it cannot be made to vary from note to note. This lack of note-to-note variation is a disadvantage. The maximum chorus effect is achieved by not only slightly detuning each pair of octavely related notes, but by also varying the specific degree of detuning from note to note within an octave. Instead of merely preventing phase synchronization between octavely related pairs of notes, this guarantees that there will also be a difference in the degree of asynchronism for each such pair. These two effects together result in fuller sound than could be achieved by repetitious use of the same degree of asynchronism.

In FIG. 3 of the Morez patent, cited above, another prior art approach to artificial chorus effect generation is disclosed. A pair of duplicate octave synthesizers is used for generating each octave, with appropriate provision for adding or subtracting a small number of pulses at the input of only one of the synthesizers of each pair, so that their effective source frequencies are not exactly the same. Once again, this approach is not directly applicable to the environment of a time-shared, variable divisor type of instrument. In addition, it does not have any provision for varying the degree of chorus effect from one note to another within an octave, because the number of pulses added or subtracted is determined on a whole-octave basis (just as it is in the other Morez approach described earlier), rather than on a note-by-note basis.

BRIEF SUMMARY OF THE INVENTION

The present invention suggests a different kind of solution to the problem of thin, dry sounding octave chords. This solution is especially applicable to the time-shared frequency divider type of instrument. A plurality of variable divisor frequency dividers is provided, each of them is connected to receive the high frequency output of the same clock source, and each divides the high frequency down to produce a musical tone signal. In addition, each may be commanded to employ, at different times, any one of a plurality of different divisors appropriate to respective different musical tones. Information as to the appropriate divisor to be used for each tone is stored in one or more memories, and that information is read out and imparted to the frequency dividers to determine the degree of frequency division accomplished at any given time. The instrument has a keyboard or other player-operated note selection means, and priority note assignment logic responds to the note selection means to command the memory to impart to a selected one of the frequency dividers the particular divisor which is appropriate to the selected note.

In its most general form, the invention involves the use of any two different frequency dividers to produce tone signals that are sounded simultaneously, the memory means imparting to the respective frequency dividers two different divisors which are not only unequal but also are not evenly divisible one by the other. Stated differently, the output frequencies of the two dividers are numerically different, and specifically are not in a 2:1 or 1:1 or other whole number ratio to each other.

In one particular form of the invention, the two frequency dividers are redundant, in the sense that they nominally sound the same note, but at slightly different frequencies (not exactly in a 1:1 ratio). This produces a rolling phase relationship which yields a chorus effect for each individual note, whether or not an octavely related note is sounded simultaneously.

In other forms of the invention, chorussing is introduced only when two of the keys are pressed simultaneously, so that two frequency dividers are activated to produce different notes simultaneously, i.e. a chord. To prevent such chords from producing a thin, dry acoustic effect when they consist only of octavely related notes, the memory stores and imparts to the two frequency dividers, for each pair of octavely related tones, respective divisors which are not exactly in a 2:1 ratio to each other, again producing a rolling phase relationship between the waveforms of the two tones.

In either form of the invention, the progressive change in phase relation effectively mimics the acoustic richness responsible for the chorus effect in a natural instrument or in the independent tone generator type of electronic instrument, both of which inherently produce random phase relationships between any pair of tones.

As an optional additional aspect of the invention, the ratio between octavely related frequencies is not only slightly different from 2:1, but also the ratio between any pair of octavely related notes, e.g. the E notes in octaves three and four, is specifically different from the ratio between any other pair of octavely related notes within those two octaves, e.g. the B notes in octaves three and four. Thus, not only is there a discrepancy in the nominal 2:1 ratio between the divisors for pairs of octavely related notes, but the specific value of the discrepancy is slightly different from note to note within an octave.

As a result, not only is there a rolling phase relationship between each pair of octavely related notes, but the rate of roll varies for each such pair across an octave. This substantially enhances the perceived chorus effect over and above what could be achieved by introducing a rolling phase relationship between each pair of octavely related notes, but employing the same rate of roll for different pairs.

Several different embodiments of the invention will now be described in detail, for the purpose of specifically illustrating the general concepts set forth above. This description will be keyed to the following drawings:

DRAWINGS

Each of the figures is a schematic functional block diagram illustrating a portion of an electronic organ.

FIG. 4 shows an alternative system architecture in which each frequency divider and memory combination is dedicated to producing a single octave, and there are as many such combinations as there are octaves within the range of the instrument.

FIG. 5 shows a variation of the system architecture in FIG. 3 which produces a chorus effect for every note sounded, even when not sounded simultaneously with another note.

DETAILED DESCRIPTION

Figure 1:
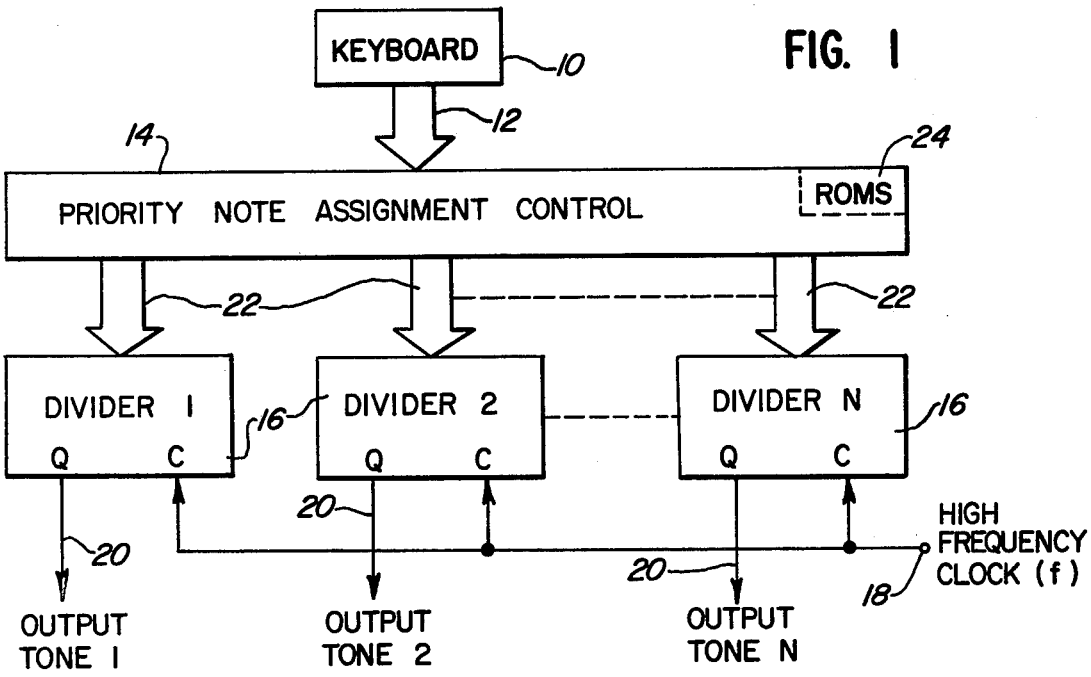
FIG. 1 shows a generalized arrangement of functional blocks applicable to any specific form of the invention, or to the prior art.

In its most general form, as seen in FIG. 1, an electronic musical instrument, for example an electronic organ, has a keyboard 10 or other form of player-operated means for selecting the notes to be played. The output of the keyboard is transmitted over a cable 12 to the priority note assignment control logic 14, which assigns the task of production of the required tone signal for each note to a selected one of a plurality of frequency dividers 16. Each divider 16 receives a clock signal of high frequency f from a common source 18, and divides it down by the appropriate division ratio to produce the required musical tone output on one of the lines 20. This is a time shared system, in which there need not be as many frequency dividers 16 as there are individual musical notes within the range of the instrument. On the contrary, the number of frequency dividers 16 may be much lower than the number of notes, because each frequency divider is capable of varying its divisor so as to produce any one of a plurality of different notes on command.

The necessary divider selection command issues from the priority note assignment control logic 14 over the appropriate one of several control cables 22. How the logic 14 makes a specific choice among the frequency dividers 16 depends upon the specific system architecture, as explained below. But in any case, the command signal which is issued by logic 14 over one of the cables 22 to the selected frequency divider 16 includes information, derived from one or more read-only memories (ROM's) 24 included in the logic circuitry 14, as to which particular divisor value (let's call it D) must be employed at a particular time by the selected frequency divider 16 in order to produce the selected musical note.

Thus, the logic circuitry 14, in general terms, receives a command that a selected note be played, selects one of the frequency dividers 16 to divide down the clock frequency f to produce that note, "looks up" the proper divisor for accomplishing that task in the information stored in a ROM 24, and causes the divisor information obtained from the ROM 24 to be transmitted to the selected frequency divider 16. The selected frequency divider then adopts the divisor value D which it has been given, and proceeds to divide the clock frequency f by the value D to produce the selected musical frequency f/D. The value of D, of course, must vary from note to note in accordance with conventional musical scale requirements.

Figure 2:
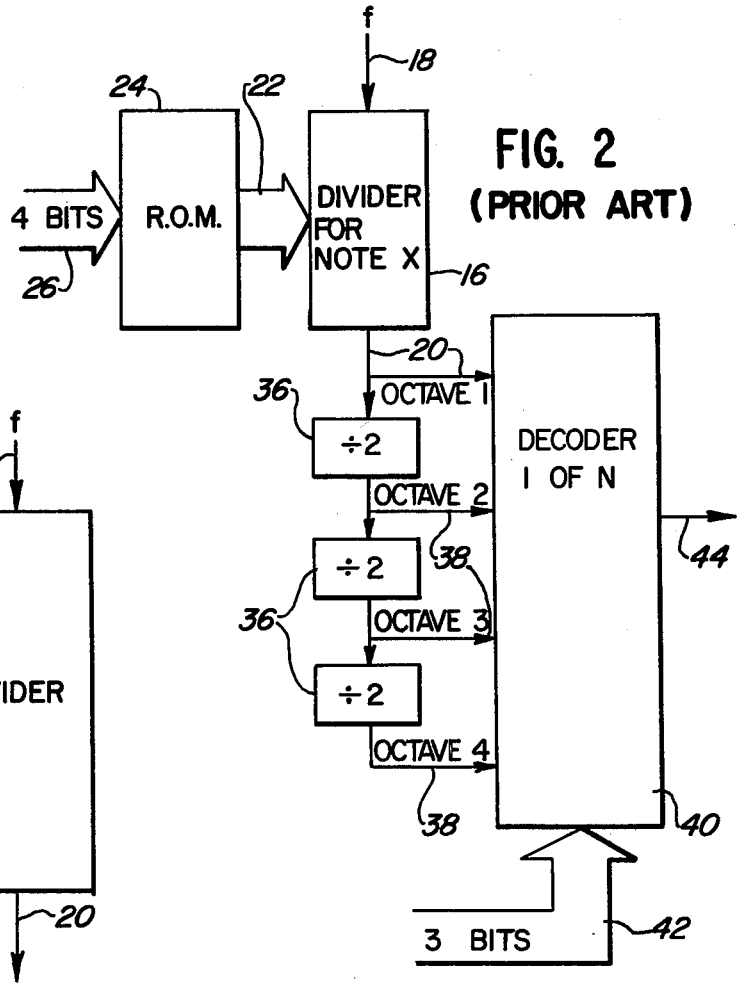
FIG. 2 (PRIOR ART)
FIG. 2 shows a particular realization of the general approach of FIG. 1 which was employed in the prior art.

When the time-sharing concept of FIG. 1 was used in the past, the system architecture employed was typically that illustrated in FIG. 2, labeled "Prior Art". There each divider 16 and its individual ROM 24 have a repertoire of twelve notes, the full chromatic complement for one octave, i.e. the highest octave within the range of the instrument. The clock frequency f arrives over line 18, and is divided down to a highest octave note, which appears on the output line 20. The precise identity of the note within the highest octave depends upon the value of the divisor imparted to the divider 16 over cable 22 by its ROM 24, which in turn depends on the four bits of information the latter receives over cable 26 from the priority note assignment logic 14 of FIG. 1. The top octave note is divided down in steps of exactly two by a chain of flip-flops 36 to produce that same note in successively lower octaves. There are as many flip-flops 36 as there are octaves (other than the top octave) in the range of the instrument. Thus all the outputs available on line 20 (the highest octave) and on a plurality of lines 38, issuing from the output terminals of respective flip-flops 36, collectively constitute an entire family of outputs in which one note is repeated for each octave over the entire range of the instrument.

In order to select which one of the available octavely related notes on output lines 20 and 38 is sounded at any given time, a 1-of-n decoder 40 is used as an octave selector. A cable 42 carries three bits of octave selection information provided by the priority note selection logic 14 of FIG. 1. This information causes the octave selector 40 to couple only the appropriate one of the octave lines 20 or 38 to a decoder output line 44. Thus, only the desired octave will appear on the output line.

The number of dividers 16 and ROM's 24 is equal to the maximum number of notes (e.g. ten to twelve) ever expected to be played simultaneously. There are also, however, an equal number of flip-flop chains 36 and decoders 40, because it is necessary to divide down from the top octave and select among the available octave outputs. Thus, the entire module seen in FIG. 2 is repeated ten to twelve times.

A more detailed description of an organ having this type of system architecture may be found in U.S. Patent Application Ser. No. 835,832 of Swain et al, filed Sept. 22, 1977 entitled "TONE GENERATING SYSTEM FOR ELECTRONIC MUSICAL INSTRUMENT", which is assigned in common with the present application and now U.S. Pat. No. 4,186,637.

Each divider 16 and ROM 24 (along with its associated octave division circuitry 36 and 40) may be called upon to generate any one of the notes within the range of the instrument. Thus, one module of the kind seen in FIG. 2 may be sounding a given note in one octave, while another of those modules may be simultaneously sounding the same note in another octave. Such octave chords must necessarily be in phase synchronization because the same source frequency f is employed for each of the frequency dividers 16, and the different octaves are obtained in each case by dividing by some exact multiple of two, by means of flip-flops 36. The result is inevitably a thin, dry-sounding octave chord. But when the time-sharing concept of FIG. 1 is used in a way consistent with this invention, for any given note the specific value of D stored in ROM 24 also varies from octave to octave by a ratio not quite equal to two. For example, take notes A3 and A4 (the A notes in the third and fourth octaves respectively), which have frequencies of 220 Hz and 440 Hz respectively. The octave relationship of these two notes nominally requires a 2:1 ratio between their frequencies, in accordance with musical theory. But in fact the information stored in the ROM 24 is such that the ratio of their actual frequencies is slightly different from 2:1, thus avoiding phase synchronism between the A3 and A4 tones. Such synchronism would otherwise result if the same clock source 18 were divided by two circuits 16 using respective divisors having a 2:1 (or any other exactly integral) ratio. It is this phase synchronism which produces the thin, dry sound which the invention aims to avoid. In contrast, when the two simultaneously sounded frequencies such as A3 and A4 are non-integrally related, they have a rolling phase relationship which produces a fuller auditory effect known as "chorus".

As a specific numerical example, if the clock frequency f is 4 MHz, the divisor stored in ROM 24 and used to produce A4 at its nominal 440 Hz would be 9091. If A3 were to be theoretically correct 220 Hz, its divisor for the same 4 MHz clock frequency would be exactly twice 9091, or 18182. But instead, ROM 24 stores a divisor value of 18,223 for A3, producing a slightly detuned frequency of 219.5. As a result, the rate of phase roll between A4 at 440 Hz and A3 at 219.5 Hz is 1 Hz. The general equations for calculating the roll rate R are:

$$R = f_H - 2f_L = \frac{f(D_H - 2\,D_L)}{D_H D_L}$$

where $f_H$ is the higher note frequency, $f_L$ is the lower note frequency, f is the clock frequency at terminal 18, $D_H$ is the divisor used for deriving the higher note frequency, and $D_L$ is the divisor used for deriving the lower note frequency. R of course is measured in Hz.

To illustrate the principle further, the following is a sample table of specific frequencies, division ratios and roll rates worked out for three notes (C, F and C#) over a six octave range:

| Note | Frequency | Division Ratio (4 MHz Clock Frequency) | Roll Rate |
|---|---|---|---|
| C8 | 4184.100 | 956 | |
| | | | −2.18 |
| C7 | 2090.956 | 1913 | |
| | | | +1.64 |
| C6 | 1046.298 | 3828 | |
| | | | −1.63 |
| C5 | 522.329 | 7658 | |
| | | | +1.60 |
| C4 | 261.968 | 15269 | |
| | | | −1.60 |
| C3 | 130.182 | 30726 | |
| F7 | 2793.296 | 1432 | |
| | | | −1.94 |
| F6 | 1395.673 | 2866 | |
| | | | +1.70 |
| F5 | 698.690 | 5725 | |
| | | | −1.58 |
| F4 | 348.558 | 11476 | |
| | | | +1.60 |
| F3 | 175.077 | 22847 | |
| C#7 | 2217.294 | 1804 | |
| | | | −1.84 |
| C#6 | 1107.726 | 3611 | |
| | | | +1.53 |
| C#5 | 554.631 | 7212 | |
| | | | −1.61 |
| C#4 | 276.510 | 14466 | |
| | | | +1.60 |
| C#3 | 135.057 | 28765 | |

Figure 3:
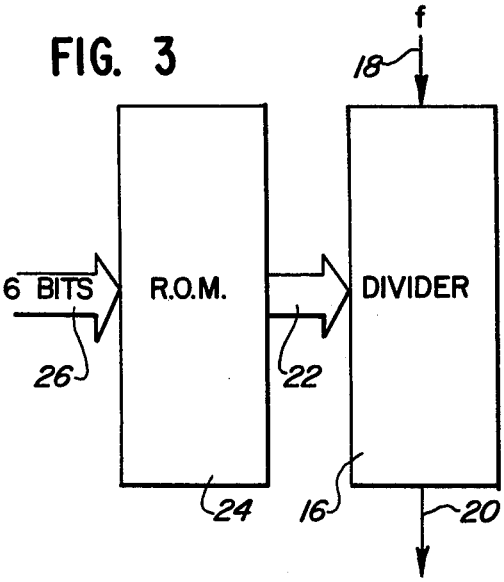
FIG. 3 shows what presently appears to be the best mode of carrying out the invention. In this embodiment each frequency divider has its own divisor memory, and each such divider and memory combination is capable of synthesizing any note within the entire range of the musical instrument.

FIGS. 3–6 show how these general concepts can be realized in several specific different organ systems. FIG. 3 illustrates a system, which is presently preferred, in which the number of variable ratio frequency dividers 16 is equal to the maximum number of individual notes which would ever need to be sounded simultaneously under the most demanding musical conditions, e.g. ten to twelve. Each of these ten to twelve dividers is then selected on an availability basis by the priority note assignment logic 14 (FIG. 1) after it becomes free (i.e. when a key is released) and its services are needed because a new key is depressed. Each of the dividers 16 is capable of employing each one of the divisor values required for producing any one of the notes in the entire musical range of the instrument; in a typical organ that would be sixty-one notes and sixty-one different divisor values. Each of the dividers 16 has its own individual ROM 24, which stores each of the sixty-one divisors required. Each ROM reads out the appropriate one of these divisors to its individual divider 16 over cable 22 when commanded to do so by a six-bit digital instruction word which arrives over a cable 26 from the priority note assignment logic 14, and specifies which particular one of the sixty-one tones is to be generated by the divider 16 at any given time. The clock frequency f arrives at the divider input over line 18, and the low frequency (divided) output appears on line 20.

In order to carry out the concepts of this invention, the sixty-one divisor values stored in each of the ten or twelve ROM's 24 are selected so that there is a ratio slightly different from two between the divisors for each pair of octavely related notes. (This condition is achieved by making sure that, relative to each divisor D which is stored in any ROM 24 for any note, all the divisors for the note one octave higher which are stored in all of the other ROM's 24 are not exactly twice D). In addition, the numerical value of the divisor ratio for any pair of octavely related notes is slightly different from the numerical value of that ratio for any other pair of octavely related notes in the same two octaves. (That condition is guaranteed by making sure that the difference between the divisors, for any two notes within one octave, which are stored in any one of the ROM's 24 is not equal to the difference between the divisors for those same two notes in any other one of the ROM's 24). The first criterion guarantees a rolling phase relation between like notes in different octaves, while the second criterion guarantees that the rate of roll will be different from note to note across any one octave.

An alternative system architecture is illustrated in FIG. 4 where there are as many of the variable divisor frequency dividers 16 and ROM's 24 as there are octaves within the range of the instrument. The high frequency clock f arrives over line 18 at the input of each divider 16, and the output tones for each octave appear on respective lines 20 leading to respective keyers 28. The keyer outputs are gathered over lines 30 leading to a summing device 32, which provides a summed audio output on line 34.

Here again each divider 16 has its own ROM 24 to provide it with divisor information over a respective cable 22. In this embodiment, however, each divider 16 is limited to producing the twelve chromatic notes for its respective octave, and its associated ROM 24 stores only the twelve divisors necessary to produce those twelve notes, imparting the proper divisor information over its cable 22. The necessary four bits of note selection information is received by each ROM 24 over its cable 26 from the priority note assignment logic 14 (FIG. 1).

The divisor information stored in the ROM 24 is arranged so that for a given note, say C sharp, any two consecutive ROM's, such as ROM's numbers two and three for the second and third octaves respectively, store divisors which are in a ratio of not quite 2:1, thus guaranteeing a rolling phase relationship between consecutive octavely related notes. In addition, the musical tone signals appear on respective output lines 20, and are processed by respective keyers 28. The keyer outputs appear on lines 30, and are then added in a summing circuit 132. The sum output, appearing on line 134, represents the tone signal for the selected musical note.

The ROM's 24 have divisor values stored therein for each of the e.g. sixty-one notes of the organ's range; and the choice of the proper divisor for the selected note depends on a four-bit instruction word received over cable 26 from the priority note assignment logic 14 (FIG. 1). Note that the same instruction goes to each redundant pair of ROM's 24 (i.e. to each pair which always produce the same note in the same octave). But each ROM 24 stores, for any given note in any given octave, a slightly different divisor value than its redundant mate ROM 24 does, for that same note in that same octave. Thus, for each note sounded there are two slightly different tone signals on the redundant pair of divider output lines 30. Therefore, these signals are not synchronized in phase; they have a rolling phase relationship, which produces a chorus effect. Thus, the sum of these two signals, on note output line 134, inherently produces a chorus effect even if the particular note on that output line 30 is not sounded simultaneously with any other note. Since this effect is present for each single note, it necessarily is present also when any two octavely related notes are played simultaneously.

To enhance the chorus effect further, the numerical values of the stored divisors are chosen so that the roll rate which occurs between the output signals issuing from each redundant pair of dividers 16 is different from note to note within any octave. Divisors are so selected that the value of this ratio changes from one note to another across the spectrum of any octave, so as to achieve a different roll rate for each different note within the octave.

The key feature in both of these embodiments of the invention is the use of stored divisors which prevent octavely related notes from having an exact 2:1 frequency ratio. This idea, however, can be generalized further: a chorus effect can be produced any time two simultaneously sounded tones have a non-integral frequency ratio. Thus, a chorus effect can also be achieved even with a single note by playing it in duplicate and having a frequency ratio which is not quite 1:1.

Applying this principle, FIG. 5 illustrates a form of the invention in which a chorus effect is produced for every note, even when that note is sounded singly instead of in a chord. In order to accomplish this, some of the tone-generating hardware is duplicated. FIG. 5 uses the same system architecture as FIG. 3, in the sense that each frequency divider 16 and its ROM 24 are capable of producing any of the e.g. sixty-one tones in the entire range of the organ. But in FIG. 5 each tone-producing unit is a duplicate pair of frequency dividers 16 and a duplicate pair of respective ROM's 24, one for each frequency divider 16. Thus the hardware depicted in FIG. 5 is the circuitry required for generating a single tone. A stream of clock pulses of high frequency f arrives over line 18 at the divide input of each of the frequency dividers 16. Both dividers then divide down the clock frequency to produce almost the same lower frequency. The resulting note is, for both dividers 16, the same one in the same octave, not different octaves as in FIGS. 3 and 4. The resulting lower frequency outputs on lines 20 go to respective keyers 28. The respective keyer outputs on lines 30 are then added by summer 132, and the sum output appearing on line 134 represents the tone signal for the selected musical note, just as in FIG. 4.

This embodiment bears a superficial resemblance to the circuit illustrated in FIG. 3 of the Morez patent, cited above; since the latter circuit also achieves a chorus effect by duplicate generation of a single note at two slightly different frequencies. To accomplish this, moreover, Morez's FIG. 3 employs duplicate frequency synthesizers, which correspond to the duplicate frequency dividers in FIG. 5 of this application. But Morez's two slightly different output frequencies are not produced because two slightly different divisor values are employed, as in the present invention; Morez does so only because two slightly different effective source frequencies are supplied, by virtue of the pulse gate which controls the input to one of the frequency synthesizers but not the other. Secondly, Morez cannot change the rate of roll from one note to another within an octave, because the source frequency differential is determined on a whole-octave basis. Each synthesizer unit generates all twelve notes of a given octave; and so all twelve notes are divided down from the same effective source frequency, the one which is applied to the input of that octave synthesizer. In contrast, the FIG. 5 embodiment of the present invention chooses the divisor value on a note-by-note basis; thus it varies the phase roll rate from note to note within an octave, which enhances the chorus effect.

Figure 6:
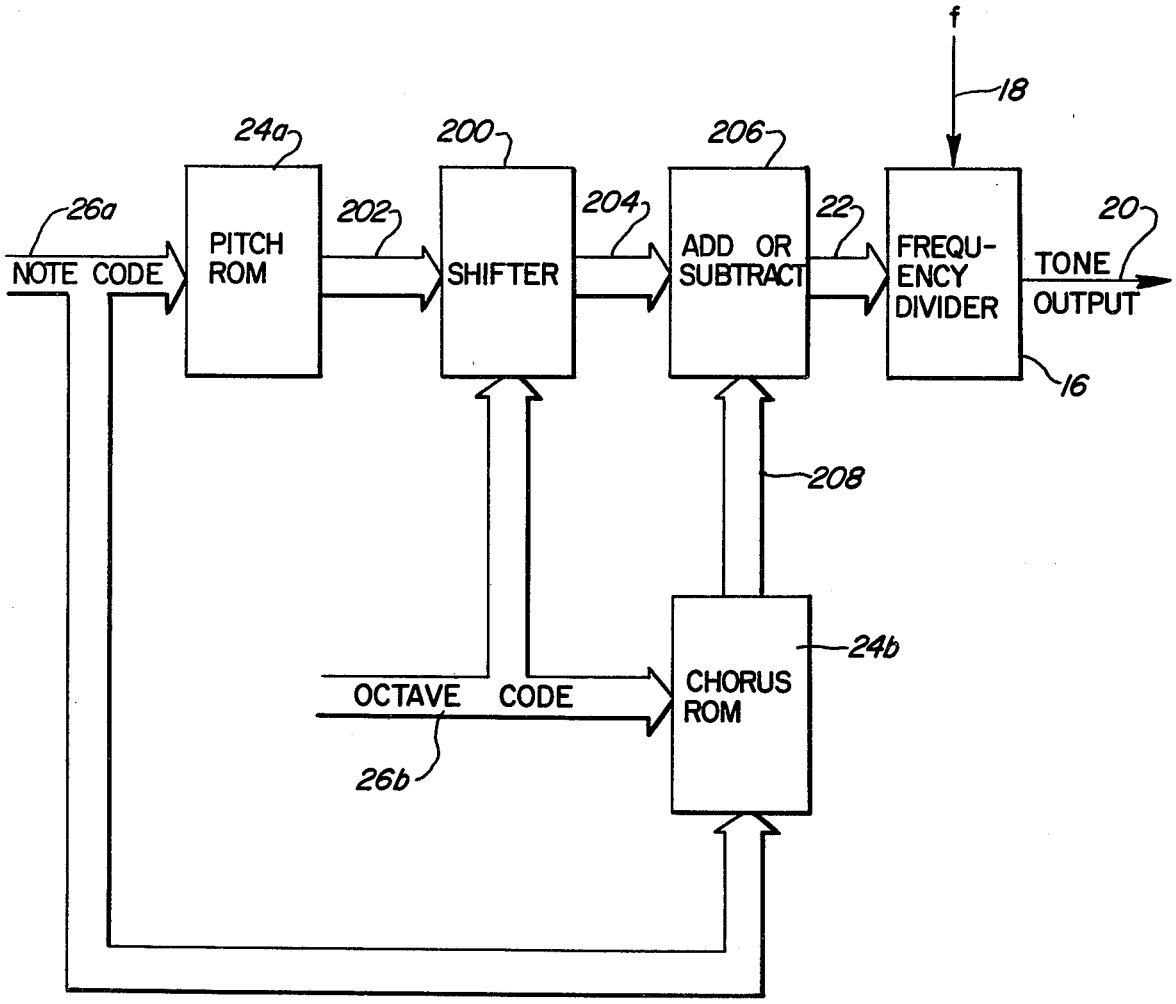
FIG. 6 shows another variation of the system architecture in FIG. 3. Here the proper octave is chosen by the simple yet elegant expedient of place-shifting a binary divisor, and chorus variations are introduced by the equally simple, equally elegant technique of adding or subtracting one or more bits to the binary divisor.

The embodiment of FIG. 6 also uses the same system architecture as FIG. 3, in the sense that each frequency divider 16 and all its associated circuits depicted in FIG. 6 are capable of producing any of the tones (sixty-one of them, for example) within the musical range of the organ. Here again, as in previously discussed embodiments, the clock frequency f arrives over line 18 at the frequency division input, and the output of the divider is a lower frequency tone on line 20. The rest of the circuitry depicted in FIG. 6 is devoted to selecting the appropriate divisor value to be used by the divider 16. In this embodiment two ROM's **24*a* and 24*b* are employed to generate the divisor values, and the divisor storage task is divided between them. ROM 24*a* stores only "true" divisor values which would be appropriate without the chorus feature of this invention, while ROM 24*b* stores only the alterations which must be made in those "true" divisor values to introduce a chorus effect by the technique of this invention. Thus ROM 24*b* eventually introduces a chorus "discrepancy" into the divisor value, but it does so only after the initial "true" divisor value supplied by ROM 24*a* has been processed by a shifter circuit 200. In the meantime, an elegant data processing trick is performed on the "true" divisor value, which permits significant economies in the cost of ROM 24*a***.

ROM **24*a* stores only the twelve divisor values needed for the top octave of the organ; not the sixty-one divisor values needed for the entire range of notes playable by the organ. Yet frequency divider 16 is required to play all sixty-one notes, and therefore requires that many divisor values. Accordingly, shifter circuit 200 converts the top octave divisor values supplied by ROM 24*a* into lower octave divisor values whenever necessary. It does this by simply shifting a binary number (the divisor value supplied by ROM 24*a* on cable 202**) by one binary place to the left for each octave step below the top octave. A moment's thought will show that, for any place-value numbering system modulo N, a shift of one place-step to the left multiplies that number by the system modulus, N. For example, in the decimal system, 10, 100, 1000 . . . is a series derived by a succession of one-step leftward place shifts, and each shift results in a multiplication by ten, which is the decimal system modulus. The same is true in binary notation, as clearly seen in the following table:

| Binary Notation | | Decimal Equivalent |
|---|---|---|
| 10 | = | 2 |
| 100 | = | 4 |
| 1000 | = | 8 |
| . | | . |
| . | | . |
| . | | . |

Since the binary system modulus is two instead of ten, each successive value in the series is twice the preceding value. Thus the shifter 200, by moving the binary divisor value on cable 202 X places to the left, inherently multiplies that divisor value by 2 a total of X times, or 2x.

In musical terms, any two notes an octave apart have a nominal or "true" frequency ratio of exactly two. Since both notes (indeed all notes produced by a given organ) are derived by division of the same source frequency (clock frequency f on line 18), it follows that ratio between the nominal or "true" divisors of any two octavely related frequencies is also exactly two. Therefore the effect of each one-place leftward shift of the binary divisor value on cable 202 by shift circuit 200 is not only to change the divisor by a factor of two, but also to change the resulting output tone frequency on line 20 by a factor of two. Since a higher divisor value produces a lower output frequency, it follows that each one-place leftward shift by circuit 200 produces a one octave reduction in the output tone frequency.

A zero place shift by shift circuit 200 allows divider 16 to produce the selected note in the top octave, whereas a leftward shift of one or more places by shift circuit 200 produces the same selected note one or more octaves lower. Thus, starting with only a repertoire sufficient for the top octave, by shifting the appropriate number of binary places to produce the lower octaves, this circuit can produce a full keyboard's worth of output tones. Yet the cost and complexity of ROM **24*a*** is significantly reduced.

Note assignment information is imparted to the ROM **24*a* over cable 26*a* coming from the priority note assignment control logic 14 (FIG. 1). No octave selection information is needed by ROM 24*a*, since it only has a one-octave capacity. The octave information (also supplied by priority note assignment control logic 14 of FIG. 1) goes instead over a cable 26*b* to the shift circuit 200. The latter responds to such information by shifting the binary divisor on cable 202 to the left, one place for each octave step below the top octave. (The same thing can also be accomplished by starting with a lowest octave divisor and shifting one binary place to the right for each higher octave step, thus halving the divisor and doubling the output frequency to jump one octave up for each place shift). The revised divisor value represents the correct octave and appears as the output of shift circuit 200 on a cable 204**.

But this revised divisor value on cable 204 still is a "true" value, without adjustment for the chorus effect. In order to add the chorus effect, an adder (or it could be subtracter) circuit 206 is provided to add (or subtract) a small amount to (or from) the "true" divisor value on cable 204 so that octavely related notes will no longer have an exact 2:1 ratio with respect to their divisor values and their output frequencies. This chorus correction is supplied by ROM **24*b* over cable 208. Thus ROM 24*b* is the "chorus ROM" which serves to increment or decrement the "true" divisor value for chorus purposes, while ROM 24*a* is the "pitch ROM" which produces the basic divisor value for the top octave, and shifter 200** provides the octave correction.

Since the exact numerical value of the increment (or decrement) to the "true" divisor value depends to some extent on the size of the divisor value, which in turn varies by a factor of two with each octave step, the chorus ROM **24*b* is provided with the octave selection information which is available from priority note assignment control logic 14 (FIG. 1) on cable 26*b***.

In some organs, or in certain sections of the keyboard of a given organ, octave selection may be done in half-octave (or even in quarter-octave) increments instead of in whole-octave increments (see the above-cited Swain et al application for details). In such event it is necessary also to supply the chorus ROM **24*b* with the note information which is available from logic circuit 14 (FIG. 1) on cable 26*a***, so that the ROM "knows" which half (or which quarter) of the selected octave the selected note is in.

The chorus ROM **24*b* stores one "correction" (increment or decrement) value for each octave in the range of the instrument (or, to the extent that octave selection is done on a half-octave or quarter-octave basis, it stores one such value for each half or quarter octave so selected). Since any given note changes frequency (and divisor value) by a factor of two from octave to octave, the correction values stored in the chorus ROM 24*b* also should change by a factor of approximately two from octave to octave (by a factor of 1.5 where selection is done on a half-octave basis, and by a factor of 1.25 where selection is done on a quarter-octave basis) so that the correction values progress roughly in step with the divisor values to which they are added or from which they are subtracted. When the octave selection (or half or quarter octave selection) information arrives on cable 26*b* (or on cables 26*b* and 26*a*), the ROM 24*b* puts out on a cable 208 the stored numerical "correction" value which is to be added to (or subtracted from) the "true" divisor value for any note in that octave (or that half or quarter octave). The adder/subtracter circuit 206 then calculates the algebraic sum of the "true" divisor value on cable 204 and the "correction " value on cable 208, and outputs the result on cable 22 as the final divisor value to be employed by divider 16 in generating the musical tone output on line 20**.

The hardware in FIG. 6 is duplicated ten or twelve times, so that as many as ten or twelve notes can be played simultaneously by the organ. But the divisor correction values stored in each of the ten or twelve chorus ROM's **24*b* are so selected that they differ from each other, by a factor slightly different from two for any two octavely related notes; thus if any two of the ten to twelve circuits of the type depicted in FIG. 6 are simultaneously generating any two octavely related notes, these notes will not hve an exact 2:1 frequency ratio, and a chorus effect will result from their rolling phase relationship. Moreover, the divisor correction values stored in the ten or twelve chorus ROM's 24*b*** are so selected that the rate of phase roll between two octavely related notes varies from note to note within any octave, to achieve the enhanced chorus effect discussed above.

Figure 7:
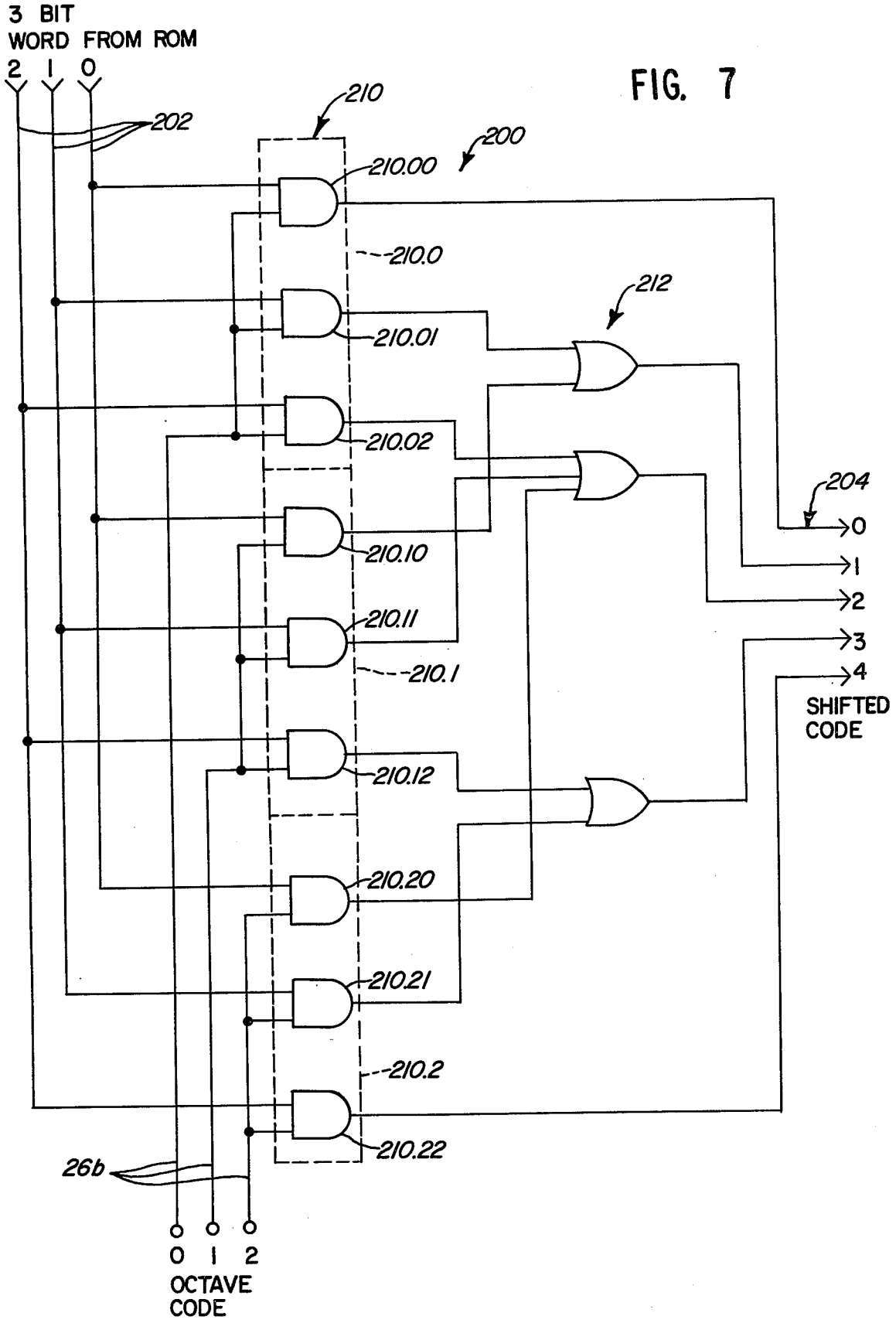
FIG. 7 is a logic diagram showing the internal circuitry of the shifter circuit seen in FIG. 6.

The shift circuit 200 of FIG. 6 may be realized in several ways, all known in the art. The best way is that which is depicted in FIG. 7. There the shift circuits 200 is seen to include AND gates 210 and OR gates 212. The incoming divisor value on cable 202 has three bits, and the incoming octave code on cable **26*b* also has three bits (the latter figure is too low for a six-octave organ, but will suffice to demonstrate the operating principle of shift circuit 200). The AND gates 210 are divided into as many groups as there are bits in the octave code on cable 26*b* (in this case three, so there are three groups of AND gates 210.0, 210.1 and 210.2 respectively). Group 210.0 is enabled by bit 0, group 210.1 is enabled by bit 1, and group 210.2 is enabled by bit 2, of the octave code on cable 26*b*. The three bits of the divisor value on cable 202 are divided up so that bit 0 goes to gate 0 of each of the three groups of AND gates 210.0, 210.1 and 210.2; or more specifically, to gates 210.00, 210.10 and 210.20. Similarly bit 1 goes to gate 1 of each group, and bit 2 goes to gate 2 of each group. The lines of output cable 204 come in some instances directly from only one of the AND gates 210, and in other instances from a plurality of the AND gates 210, in which case buffering is provided by the OR gates 212. A routine analysis of the circuit shows that the three input bits on lines 202 always appear on three consecutive output lines 204, and in the same order as they did on the input lines 202, but shifted in one direction or another (i.e. on lines 0, 1, and 2; or 1, 2 and 3; or 2, 3 and 4) as a function of the value of the input on lines 26***b*. Other forms of conventional data-shifting circuitry are also satisfactory for this application.

It will now be appreciated that by the appropriate choice of hardware configuration and the use of divisors which do not have an exact 1:1 or 2:1 ratio, the thin, dry sound which results from a lack of chorus effect can be avoided, even in a priority note assignment type of organ. In each of the embodiments described, the chorus effect is introduced at least when octavely related notes are sounded, and in one case it is produced even when a note is sounded alone.

The described embodiments of the invention are merely examples of the many ways in which the invention might be carried out. Numerous other ways may also be possible, and should be considered to be comprehended within the scope of the appended claims.

What is claimed is:

1. In a tone generator of the type having:

a high frequency clock source which is employed as a common frequency standard for generating each one of a plurality of musical tones over a range of more than one octave;

and a plurality of variable divisor frequency dividers each of which is connected to receive at any one time only a single frequency input, said frequency input being derived from the high frequency output of said clock source, and each of which is capable of dividing said high frequency by only one divisor at any one time to produce only a single lower frequency musical tone at any one time, and each of which is capable of being commanded to employ, at different times, any one of a plurality of different divisors appropriate to respective different ones of said musical tones;

the improvement comprising means for supplying to respective ones of said frequency dividers, for generating respective octavely related tones, instructions commanding the use of respective divisors which are not exactly in a 2:1 ratio to each other, whereby a chorus effect is produced when such tones are sounded simultaneously.

2. A tone generator as in claim 1 wherein said instruction supplying means commands the use of divisors, for any two octavely related tones the exact value of the ratio between which is different from note to note within any octave.

3. A tone generator as in claim 1 wherein:

each of said frequency dividers is capable of employing the appropriate divisor for any note within said range of musical tones;

and said instruction supplying means comprises respective individual instruction suppliers cooperating with respective frequency dividers, each of said individual instruction suppliers being capable of supplying the appropriate divisor instructions for all the musical scale notes within said range of musical tones.

4. A tone generator as in claim 3 wherein said individual instruction suppliers command the use of divisors, for any two octavely related notes, the exact value of the ratio between which is different from note to note within any octave.

5. A tone generator as in claim 1 wherein:

there is one of said frequency dividers for each octave within said range of musical tones;

said instruction supplying means includes respective individual instruction suppliers for each such octave;

each of said individual instruction suppliers cooperates with its corresponding frequency divider for the same octave;

and each individual instruction supplier commands the use of a respective divisor for each note within its assigned octave.

6. An instrument as in claim 5 wherein:

the ratio between (a) the divisor, use of which is commanded by any of said individual instruction suppliers for use in generating any one note in a given octave, and (b) the divisor, use of which is commanded by any other of said individual instruction suppliers for use in generating any note octavely related thereto, differs from note to note within any octave.

7. In a tone generator of the type having:

a high frequency clock source which is employed as a common frequency standard for generating two musical tone signals;

two variable divisor frequency dividers each of which is connected to receive at any one time only a single frequency input, said frequency input being derived from the high frequency output of said clock source, and each of which is capable of dividing said high frequency by only one divisor at any one time to produce only a single musical tone at any one time, and each of which is capable of being commanded to employ any one of a plurality of different divisors at different times;

the improvement comprising means for supplying to the respective frequency dividers, for generating a pair of musical tones having frequencies one of which is integrally divisible by the other, instructions commanding the use of respective divisors neither of which is quite integrally divisible by the other, whereby said musical tone signals are not synchronized in phase.

8. A tone generator as in claim 7 wherein said divisors are almost but not quite in a 2:1 ratio.

9. A tone generator as in claim 7 wherein said divisors are almost but not quite in a 1:1 ratio.

10. A tone generator as in claim 9 wherein said frequency dividers are both employed to generate the same musical note in the same octave.

11. A tone generator as in claim 7 wherein said instruction supplying means comprises:

means for supplying true divisor values;

means for supplying chorus correction values to be applied to said true divisor values; and calculating means for modifying said true divisor values as a function of said chorus correction values, and supplying the results as divisor instructions to said frequency dividers.

12. A tone generator as in claim 11 wherein said calculating means is an arithmetic unit which increments or decrements said true value by said correction value.

13. A tone generator as in claim 11 wherein said true divisor value supplying means supplies only enough true divisor values for less than the required number of octaves; further comprising means for multiplying or dividing said true divisor values by a power of two whereby said tone generator is enabled to produce notes in octaves for which true divisor values are not supplied by said true divisor value supplying means.

14. A tone generator as in claim 13 wherein the divisor values which are to be multiplied or divided by a power of two are supplied in binary notation, and said multiplying or dividing means comprises circuitry for shifting said binary notation divisor values by a number of binary places equal to the power of two by which they are to be multiplied or divided.

15. A tone generator comprising:

a high frequency clock source which is employed as a common frequency standard for generating each one of a plurality of musical tones over a range of more than one octave;

a plurality of variable divisor frequency dividers each of which is connected to receive at any one time only a single frequency input, said frequency input being derived from the high frequency output of said clock source, and each of which is capable of dividing said high frequency by only one divisor at any one time to produce only a single musical tone at any one time, and each of which is capable of being commanded to employ, at different times, any one of a plurality of different divisors appropriate to respective different ones of said musical tones;

means for storing information as to which divisors are appropriate to each of the musical tones within less than the required number of octaves;

means for multiplying said divisor values by a power of two selected from the range of positive and negative numbers whereby to derive divisor value information suitable for other octaves;

and means for imparting said information to said frequency dividers to select the respective divisors employed thereby at any given time.

16. A tone generator as in claim 15 wherein the divisor values which are to be multiplied by a power of two are supplied in binary notation, and said multiplying means comprises circuitry for shifting said binary notation divisor values in a selected direction by a number of binary places equal to the power of two by which they are to be multiplied.

17. A method of generating a selected pair of musical tones comprising the steps of: (1) employing a high frequency source as a common frequency standard; (2) simultaneously using each of two frequency dividers for dividing at any one time only a single frequency input, said frequency input being derived from said common source frequency, said frequency dividers each being of the type which divides said high frequency by only one divisor at any one time to produce only a single lower frequency musical tone at any one time, and each being of the type which is capable of being commanded to employ, at different times, any one of a plurality of different divisors appropriate to different musical tones; and (3) commanding said frequency dividers simultaneously to use two divisors which are almost but not exactly in a whole number ratio to each other to simultaneously produce musical notes whose frequencies are almost but not exactly in a whole number relationship to each other; thereby causing the frequencies of said notes to have a rolling phase relationship to each other which produces a chorus effect.

18. The method of claim 17 wherein said divisors are almost but not exactly in a 2:1 ratio to each other whereby said musical notes are nominally octavely related but have a rolling phase relationship which produces a chorus effect.

19. A method as in claim 18 wherein said source is used as a common frequency standard for generating each one of a plurality of musical tones over a range of more than one octave, within which range any two octavely related tones are produced by dividing said common source frequency by two different divisors which are almost but not exactly in a 2:1 ratio to each other so that each pair of octavely related tones, when generated simultaneously, have a rolling phase relationship to each other whereby to produce a chorus effect, and employing somewhat different ratios between the divisors for each pair of octavely related tones so that the phase roll rate varies from note to note within any octave to enhance the chorus effect.

20. A method as in claim 17 wherein said divisors are almost but not exactly in a 1:1 ratio to each other whereby said musical notes are nominally the same but have a rolling phase relationship which produces a chorus effect.

21. A method as in claim 20 wherein said source is used as a common frequency standard for generating each one of a plurality of musical tones over a selected range, within which range each tone is always duplicately generated by simultaneously dividing said common source frequency by two divisors which are almost but not exactly in a 1:1 ratio to each other so that the simultaneous duplicate versions of said tone have a rolling relationship to each other whereby to produce a chorus effect, and employing somewhat different ratios between the divisors for each pair of duplicate tones so that the phase roll rate varies from note to note within said range to enhance the chorus effect.

22. A method as in claim 17 wherein said divisor values are calculated by starting with a preliminary divisor value and incrementing or decrementing said preliminary divisor value to produce at least one corrected divisor value which is almost but not exactly in a whole number ratio to said preliminary divisor value.

23. A method as in claim 18 wherein said divisor values are calculated by starting with a first divisor value expressed in binary notation, shifting said binary expression one binary place to produce a second divisor value expressed in binary notation which is in a 2:1 ratio to said first divisor value, and incrementing or decrementing at least one of said divisor values so that they are no longer exactly in a 2:1 ratio to each other.

* * * * *